United States Patent [19]

McNabney

[11] 4,254,795

[45] Mar. 10, 1981

[54] AIRFLOW CONTROL MECHANISM INSERTABLE INTO AN AIR DUCT

[75] Inventor: John C. McNabney, Verona, Wis.

[73] Assignee: Wehr Corporation, Milwaukee, Wis.

[21] Appl. No.: 27,673

[22] Filed: Apr. 6, 1979

[51] Int. Cl.[3] ..... F23L 13/08

[52] U.S. Cl. ..... 137/454.6; 98/121 A; 137/601

[58] Field of Search ..... 98/40 R, 40 V, 40 VM, 98/41 R, 110, 121 A; 137/454.6, 601

[56] References Cited

U.S. PATENT DOCUMENTS

| | | | |
|---|---|---|---|
| 2,397,672 | 4/1946 | Leigh | 98/107 |
| 3,123,098 | 3/1964 | Bishop | 137/601 |
| 3,282,504 | 11/1966 | Foster | 236/1 |
| 3,366,141 | 1/1968 | Foster | 137/625.31 |
| 3,575,229 | 4/1971 | Alley | 98/114 X |
| 3,715,971 | 2/1973 | Moyer | 98/121 A X |
| 4,076,035 | 2/1978 | Frisch | 137/601 |

*Primary Examiner*—Robert G. Nilson

[57] ABSTRACT

The invention provides an air flow control mechanism adapted to be slideably insertable into an air duct without substantial structural modification of the air duct and without requiring shut down of the air system.

7 Claims, 2 Drawing Figures

AIRFLOW CONTROL MECHANISM INSERTABLE INTO AN AIR DUCT

BACKGROUND OF THE INVENTION

The present invention relates to air conditioning and heating systems and more particularly to an air flow control mechanism which can be readily inserted into an air duct of an existing air flow system without substantial structural modification of the duct system and without shutting down the air flow system.

For examples of conventional air flow control mechanisms, attention is directed to the U.S. Foster Pat. No. 3,366,141, issued Jan. 30, 1968; the U.S. Foster Pat. No. 3,495,521, isued Feb. 17, 1970; the U.S. Foster Pat. No. 3,282,504; issued Nov. 1, 1966; the U.S. Bishop Pat. No. 3,123,098, issued Mar. 3, 1964; and the U.S. Leigh Pat. No. 2,397,672, issued Apr. 2, 1946.

SUMMARY OF THE INVENTION

The present invention is intended to provide an improved air flow control mechanism or air flow control valve which can be conveniently inserted into existing duct work without replacement of sections of the ducts or other extensive modifications, and more particularly, without shut-down of the air flow system. The air flow valve comprises a compact unit which can be readily slipped into the air duct by cutting a rectangular hole in one of the side walls of the duct wherein the air valve can be slipped into the duct. The air flow control valve eliminates the need for transitions or extensive modification of the existing ducts and allows rapid, simple installation without shutting down the heating or air conditioning system.

More specifically, the invention includes an air flow control mechanism for use in an air duct having an aperture therein and for controlling air flow through the air duct. The air flow control mechanism includes a housing adapted to be slideably inserted through the aperture in the duct, the housing including a plurality of side walls positionable adjacent the interior surface of the duct. The air flow control mechanism also includes means for supporting the housing in the air duct and including a flange fixedly attached to the housing and adapted to surround the aperture and to be screwed or otherwise fixed to the air duct. The air flow control mechanism also includes means for providing a seal between the housing and the interior surface of the air duct for preventing air flow around the housing, the seal means including elongated resilient seals fixedly attached to the external surface of the frame and engageable against the internal surface of the air duct.

One of the principal features of the invention is the provision of the seals being elongated blades each having one longitudinal edge secured to the housing and an opposed longitudinal edge engaging the interior surface of the air duct, and wherein the blades are particularly constructed such that air pressure in the air duct forces the opposed longitudinal edges into engagement with the interior surface of the air duct.

Another of the advantages of the invention stems from the provision of seals having a configuration accomodating slideable insertion of the air valve yet also preventing air flow around the unit by expanding under pressure against the inside surfaces of the duct.

A further advantage of the invention stems from the provision of a mounting flange which facilitates convenient attachment of the air valve to the air duct. An additional advantage of the air valve is that its construction facilitates the inclusion of an insulation layer between the frame of the air valve and the mounting flange to thereby insure the integrity of the duct insulation over that portion of the duct which is removed to permit installation of the unit.

Figure 1:
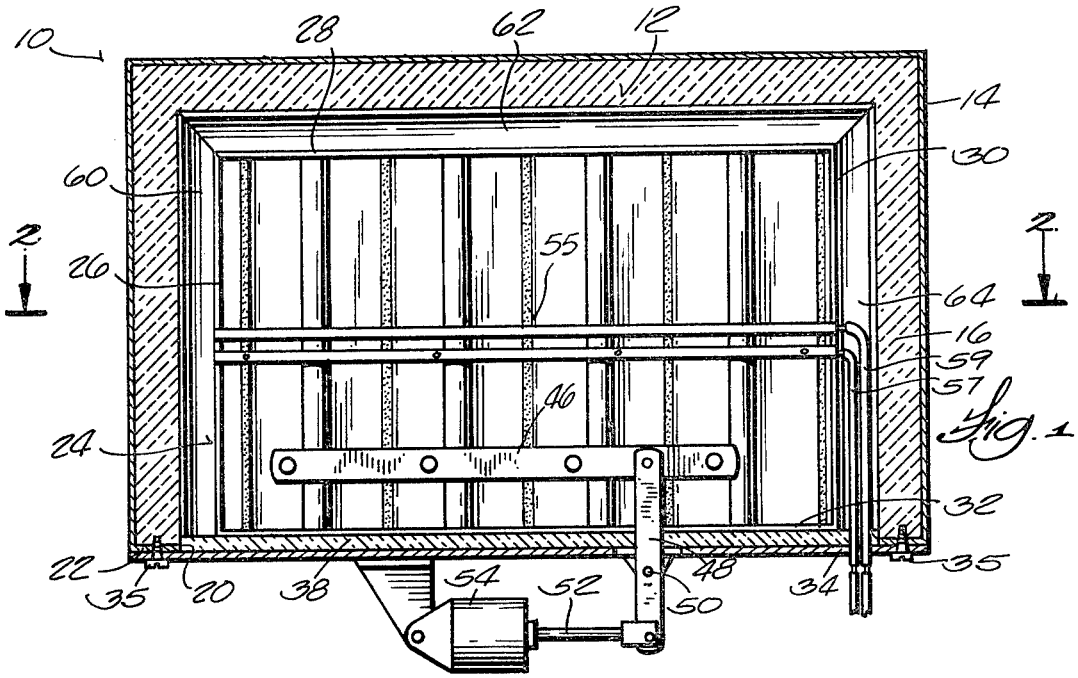
FIG. 1 is a cross section plan view of an air duct including an air valve therein, the air valve embodying the invention.

Before describing at least one embodiment of the invention in detail, it is to be understood that the invention is not limited in its application to the details of construction or the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE DEFERRED EMBODIMENT

Figure 2:
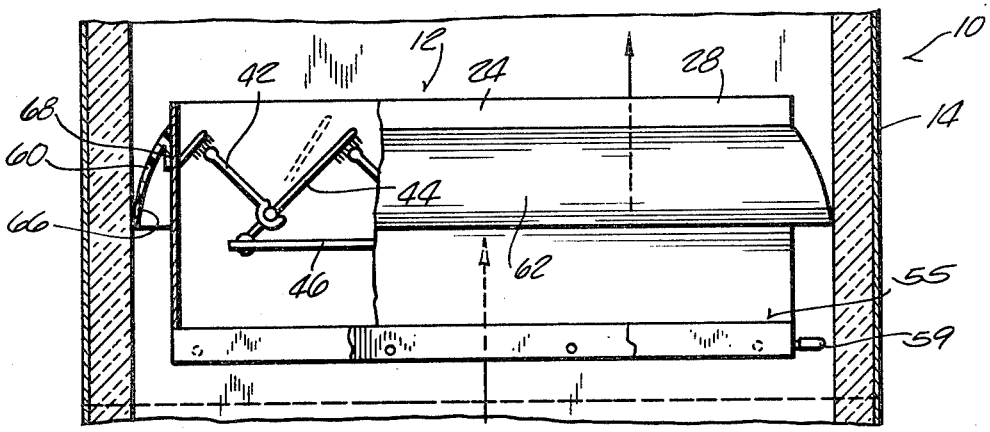
FIG. 2 is a view taken along line 2—2 in FIG. 1.

Illustrated in FIGS. 1 and 2 is an air duct 10 of the type commonly employed in air conditioning and heating systems and housing an air valve 12 therein, the air valve 12 being provided to facilitate the control of air flow through the air duct 10. The air duct 10 is comprised of a sheet metal housing 14 or the like having a layer of asbestos matting insulation 16 boned to the inner surface of the housing 14. The asbestos matting is intended in part to provide thermal insulation for the air duct to restrict heat exchange between the air flowing through the air duct and the ambient air surrounding the air duct.

While the air valve 12 can have various configurations, in the illustrated construction, the air valve 12 is adapted to be freely slidably inserted into the air duct 10 through a rectangular aperture 20 cut in the bottom wall 22 of the air duct. The air valve 12 is generally comprised of a rectangular sheet metal housing 24 including side walls 26, 28, 30 and 32, and being open at its opposite ends. As shown in FIG. 2, in one embodiment, the housing 24 can have a thickness substantially less than its height or width, but other external configurations are also within the scope of the invention. The housing 24 is intended to be somewhat smaller than the interior of the air duct such that the housing 24 can be slidably positioned therein. The air valve 12 also includes a flange plate 34 secured to the side wall 32 of the housing 24, the flange plate 34 including outwardly extending peripherial edges intended to overlap the edges of the rectangular opening or aperture 20 in the bottom wall 22 of the air duct whereby the air valve 12 can be secured to the duct by screws 35.

In the preferred embodiment of the invention, a layer of insulation material 38 is also sandwiched between the side wall 32 of the housing 24 and the flange plate 34 to thereby retard heat transfer from the air duct 10 and to compensate for removal of a section of insulation during cutting of the rectangular aperture 20.

It should be recognized that while the air valve is illustrated as being slidably inserted through an aperture 20 in the bottom wall of the air duct 10, the air valve 12 could similarly be received through apertures in either of the side walls 26 or 30 or through the top wall 28 of the air duct.

The air valve 14 further includes a plurality of generally parallel vanes or blades 42 and 44 disposed in the rectangular opening defined by the walls 26, 28, 30 and 32 and functional to limit or control the air flow through the air duct. While the vanes 42 and 44 may have various configurations and may be supported in various ways, in the illustrated construction, the parallel vanes 42 and 44 comprise a first set of parallel spaced apart stationary vanes 42, rigidly supported at their opposite ends by the spaced walls 28 and 32. The stationary vanes 42 are substantially planar and are each supported at an upper end by the wall 28 and at a lower end by the wall 32.

The air valve 14 also includes a plurality of pivotable vanes 44, each pivotable vane 44 being supported between a pair of the stationary vanes 42 and defining an enlongated structure similar to that of the stationary vanes 42. These pivotable vanes 44 each have an upper end positioned against the upper wall 28 of the housing 24 and a lower end positioned against the lower wall 32 of the housing. The pivotable vanes 44 are pivotably attached at one of their edges to an edge of respective ones of the stationary vanes 42 and their other edge is movable through an arcuate path toward and away from an opposed edge or surface of an adjacent respective stationary vanes 42 thereby providing for variation of the air flow through the air valve 12.

Means are also provided for causing pivotal movement of the movable vanes 44 from the position wherein their edges are spaced from respective adjacent surfaces of adjacent stationary vanes 42 to a position wherein a portion of the movable vanes 44 is in closely adjacent position to a surface of the stationary vane 42. Such means comprise an enlongated translationally movable bar 46 pivotably connected to an edge of each of the pivotable vanes 44 and including means for causing translational movement of the translationally movable bar 46. The means for causing translational movement comprises a lever 48 having one end pivotably connected to one end of the translationally movable bar 46 and connected by a pivot pin 50 at a point intermediate its opposite ends to the housing 24. The end of the lever 48 opposite that end connected to the translationally movable bar 46, is pivotably connected to a translationally movable actuating rod 52 projecting from an actuator 54. While the actuator 54 can have various configurations, in the illustrated construction, the actuator 54 comprises a pneumatically operated piston and cylinder, the actuator rod 52 forming the piston rod of the piston and cylinder. The actuator 54 is fixedly attached to the external surface of the flange plate 34 to thereby form an integral component of the air valve 12. In a preferred form, the actuator 54 is connected to a source of air pressure and a thermostatic control through a pair of air lines.

The thermostatic control can be any conventional control device such as that shown in the U.S. Travaglio et. al. Pat. No. 3,941,310 issued Mar. 2, 1976, and assigned to the assignee of the present invention. Thermostatic controls of the type described therein control the air flow and air pressure supplied to the actuator from an air pressure source.

The air valve 12 also includes a fluid flow measuring apparatus 55 of the type described in detail in co-pending U.S. Pat. Application Ser. No. 940,585, filed Sept. 8, 1978, now U.S. Pat. No. 4,197,740, and assigned to the assignee of the present invention. As more particularly described in that application, the fluid flow measuring apparatus 55 functions to sense the air pressure and air velocity through the air valve 14. The fluid flow measuring apparatus is adapted to be connected to the thermostatic control device through a pair of conduits 57 and 59. In operation the air pressure and/or velocity through the valve will be sensed by the fluid flow measuring apparatus 55 to cause actuation of the actuator 54 and movement of the moveable vanes of the air valve.

Means are also provided for forming a seal between the outer surface of the air valve housing 24 and the inside surface of the asbestos insulation layer 16 of the air duct 10 when the air valve 12 has been slideably inserted through the aperture 20. The seal forming means includes three elongated resilient sealing strips or blades 60, 62 and 64 fixedly attached to the exterior surfaces of the side walls 26, 28 and 30 of the air valve housing 24 and forming a continuous and uninterrupted seal around those three sides of the housing 24 and between the housing and the internal surface of the air duct. The elongated resilient blades 60, 62 and 64 each have a cross-sectional configuration as illustrated in FIG. 2 and form a narrow arcuate vane or blade portion 66 tapering from a portion of the seal adjacent the external surface of the housing 24 to the free edge portion of the blade which engages the internal surface of the duct, and the blade portion 66 being curved about the longitudinal axis of the seal and upstream with respect to the direction of air flow through air duct. Stated alternatively the elongated seals 60, 62 and 64 also each include one longitudinal edge portion 68 having a planar surface adapted to be bonded to the external surface of the housing. The configuration of the seals is such that when the air valve 12 is in operation in an air duct 10, the air flow through the air duct 10 causes the longitudinal edges of the seals to be forced against the internal surface of the air duct insuring sealing of the air valve in the air duct.

Various features of the invention are set forth in the following claims.

I claim:

1. An air flow control mechanism for use in an air duct having upstream and downstream ends and an aperture in the air duct intermediate the upstream and downstream ends, the air flow control mechanism comprising:

a housing adapted to be slideably inserted through the aperture into the air duct, said housing including a plurality of side walls positionable adjacent the interior surface of the duct but in spaced relation from the interior surface of the duct, means for supporting said housing in the air duct, said supporting means including a flange fixedly attached to said housing and for surrounding the aperture, the flange being adapted to be fixed to the air duct, and means for providing a seal between the housing and the interior surface of the air duct for preventing air flow around the housing, said seal means including elongated resilient blades fixedly attached to the external surface of the housing and engageable against the internal surface of the air duct, said resilient blades each including one longitudinal edge secured to said housing and an opposite longitudinal edge engageable against the interior surface of the air duct, and said blades each being curved toward the air flow whereby air pressure against said blades forces said opposite longitudinal edges against the interior surface of the air duct.

2. An air flow control mechanism as set forth in claim 1 wherein said housing includes a plurality of sides foming a rectangular air flow opening therebetween, and further including a flange plate secured to one of said sides, said flange plate including a peripheral edge defining said flange.

3. An air flow control mechanism for use in an air duct having an aperture therein and for controlling air flow through the air duct, the air flow control mechanism comprising:

a housing adapted to be slideably inserted through the aperture into the air duct, said housing including a plurality of side walls forming a rectangular air flow opening and positionable adjacent the interior surface of the duct, and means for supporting said housing in the air duct, said supporting means including a flange plate secured to one of said sides, said flange plate including a peripheral edge defining a flange adapted to surround the aperture, the flange being adapted to be fixed to the air duct, an insulation layer between said flange plate and said one of said sides, and means for providing a seal between the housing and the interior surface of the air duct for preventing air flow around the housing, said seal means including elongated resilient blades fixedly attached to the external surface of the housing and engageable against the internal surface of the air duct, said blades each including one longitudinal edge secured to said housing and an opposite longitudinal edge engageable against the interior surface of the air duct and wherein said blades are curved toward the air flow whereby air pressure against said blades forces said opposite longitudinal edges against the interior surface of the air duct.

4. An air flow control mechanism for use in an air duct having an aperture therein and for controlling air flow through the air duct, the air flow control mechanism comprising:

a housing adapted to be slideably inserted through the aperture into the air duct, said housing including a plurality of side walls forming a rectangular air flow opening and positionable adjacent the interior surface of the duct, means for supporting said housing in the air duct, said supporting means including a flange plate secured to one of said sides, said flange plate including a peripheral edge defining a flange adapted to surround the aperture, the flange being adapted to be fixed to the air duct, an insulation layer between said flange plate and said one of said sides, and means for providing a seal between the housing and the interior surface of the air duct for preventing air flow around the housing, said seal means including elongated resilient blades fixedly attached to the external surface of the housing and engageable against the internal surface of the air duct.

5. An air distribution system comprising:

an air duct having an aperture therein, and an air flow control mechanism slideably insertable through said aperture into said air duct and for controlling air flow through said air duct, said air flow control mechanism including a housing having a plurality of peripheral sides, said housing defining an air flow space therethrough, and a peripheral flange extending peripherally outwardly from one of said sides, said flange surounding said aperture and being fixedly attached to said air duct.

means for controlling the volume of air flow through said air flow space, said controlling means including a plurality of vanes supported in said air flow space, at least one of said vanes being pivotable between a first position and an air flow limiting position, means for causing movement of said at least one vane between said positions including an actuator supported by said housing, said actuator including a movable piston connected to said movable vane, and means for providing a seal between said housing and the internal surface of said duct for preventing air flow around said housing, said seal means including elongated resilient blades fixedly attached to the external surface of said housing and engageable against the internal surface of said air duct, said blades including one longitudinal edge secured to said housing and an opposite longitudinal edge engageable against the interior surface of said air duct, said blades being curved toward said air flow whereby air pressure against said blade forces said opposite longitudinal edge against the interior surface of said air duct.

6. An air flow control mechanism as set forth in claim 5 wherein said plurality of sides form a rectangular air flow opening, and further including a flange plate secured to one of said sides, said flange plate including a peripheral edge defining said flange.

7. An air distribution system comprising:

an air duct having an aperture therein, and an air flow control mechanism slideably insertable through said aperture into said air duct and for controlling air flow through said air duct, said air flow control mechanism including a housing having a plurality of peripheral sides, said housing defining a rectangular air flow opening therethrough, and a peripheral flange plate secured to one of said sides, said flange plate defining a flange extending peripherally outwardly from said one of said sides, said flange surrounding said aperture and being fixedly attached to said air duct, an insulation layer between said flange plate and said one of said sides, means for controlling the volume of air flow through said air flow space, said controlling means including a plurality of vanes supported in said air flow space, at least one of said vanes being pivotable between a first position and an air flow limiting position, means for causing movement of said at least one vane between said positions including an actuator supported by said housing, said actuator including a movable piston connected to said moveable vane, and means for providing a seal between said housing and the internal surface of said duct for preventing air flow around said housing, said seal means including elongated resilient blades fixedly attached to the external surface of said frame and engageable against the internal surface of said air duct.

* * * * *